US010030829B2

(12) United States Patent
Aliakseyeu et al.

(10) Patent No.: US 10,030,829 B2
(45) Date of Patent: Jul. 24, 2018

(54) LIGHTING CONTROL BASED ON DEFORMATION OF FLEXIBLE LIGHTING STRIP

(71) Applicant: PHILIPS LIGHTING HOLDING B.V., Eindhoven (NL)

(72) Inventors: Dzmitry Viktorovich Aliakseyeu, Eindhoven (NL); Dirk Valentinus René Engelen, Heusden-Zolder (BE); Philip Steven Newton, Waalre (NL); Tim Dekker, Eindhoven (NL); Ramon Antoine Wiro Clout, Eindhoven (NL); Bartel Marinus Van De Sluis, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/327,122

(22) PCT Filed: Jul. 13, 2015

(86) PCT No.: PCT/IB2015/055283

§ 371 (c)(1),
(2) Date: Jan. 18, 2017

(87) PCT Pub. No.: WO2016/009324

PCT Pub. Date: Jan. 21, 2016

(65) Prior Publication Data

US 2017/0167670 A1 Jun. 15, 2017

Related U.S. Application Data

(60) Provisional application No. 62/026,170, filed on Jul. 18, 2014.

(51) Int. Cl.
*F21S 4/22* (2016.01)
*H05B 33/08* (2006.01)
(Continued)

(52) U.S. Cl.
CPC ..... *F21S 4/22* (2016.01); *H05B 33/0803* (2013.01); *H05B 33/0857* (2013.01); *F21Y 2103/10* (2016.08); *F21Y 2115/10* (2016.08)

(58) Field of Classification Search
CPC .... F21S 4/22; H05B 33/0803; H05B 33/0857
See application file for complete search history.

(56) References Cited

U.S. PATENT DOCUMENTS 6,016,038 A 1/2000 Mueller et al.
6,211,626 B1 4/2001 Lys et al.
(Continued)

FOREIGN PATENT DOCUMENTS

WO 2011151272 A1 12/2011

*Primary Examiner* — Thomas M Sember

(57) ABSTRACT

In various embodiments, one or more signals indicative of a shape formed by a flexible lighting strip (100) may be obtained, e.g., from one or more sensors (110) secured to the flexible lighting strip. One or more deformations in the flexible lighting strip may be detected based on the one or more signals. One or more light sources (102) may be selectively energized based on the one or more detected deformations. In some embodiments, one or more light sources contained in a first logical partition of the flexible lighting strip bound by at least one deformation may be energized to emit light having a first property. One or more light sources contained in a second logical partition of the flexible lighting strip separated from the first logical partition by at least one deformation may be energized to emit light having a second property different than the first property.

20 Claims, 5 Drawing Sheets

(51) Int. Cl.
*F21Y 103/10* (2016.01)
*F21Y 115/10* (2016.01)

(56) References Cited

U.S. PATENT DOCUMENTS

| | | | | |
|---|---|---|---|---|
| 8,714,772 | B1 | 5/2014 | Levante et al. | |
| 2005/0162850 | A1 | 7/2005 | Luk et al. | |
| 2005/0242822 | A1* | 11/2005 | Klinger ..... | B60Q 11/005 324/523 |
| 2009/0147504 | A1 | 6/2009 | Teeters | |
| 2013/0021811 | A1 | 1/2013 | Goldwater | |
| 2013/0249417 | A1 | 9/2013 | Verlinden | |

* cited by examiner

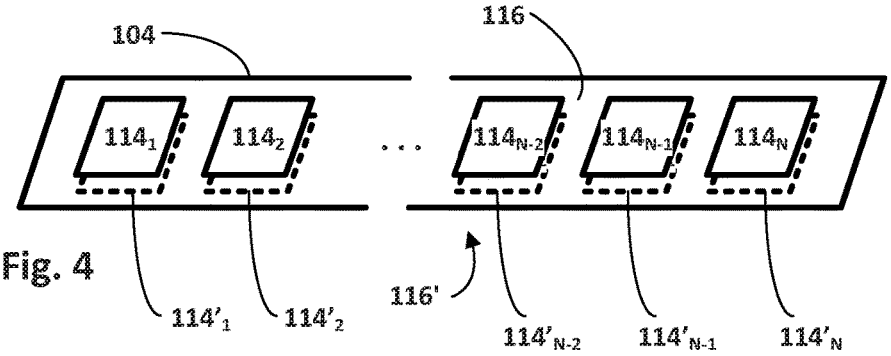
Fig. 4
Fig. 5
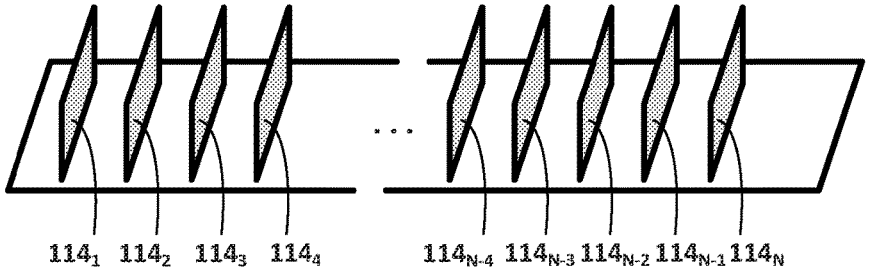
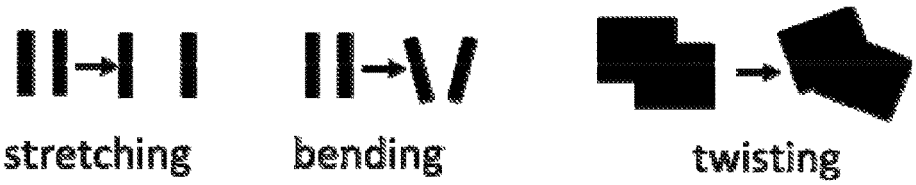
Fig. 6

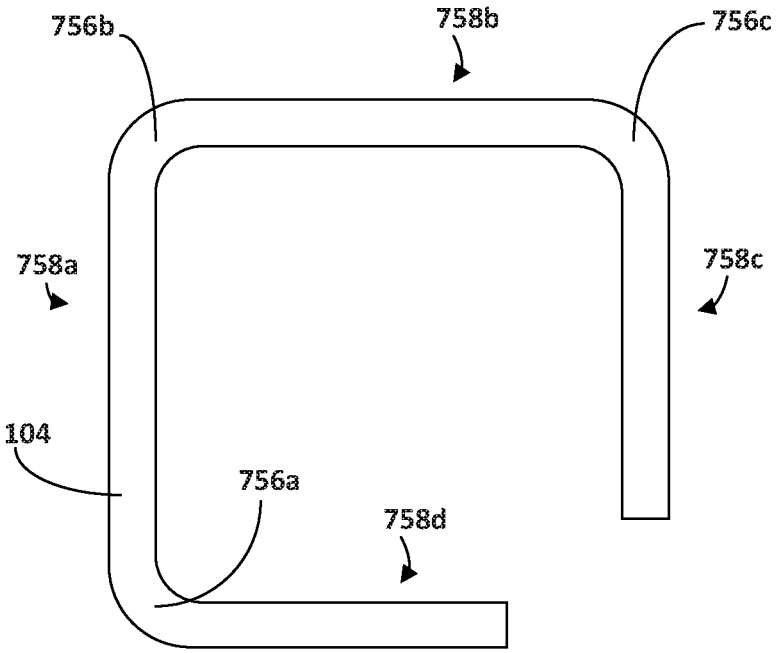
Fig. 7
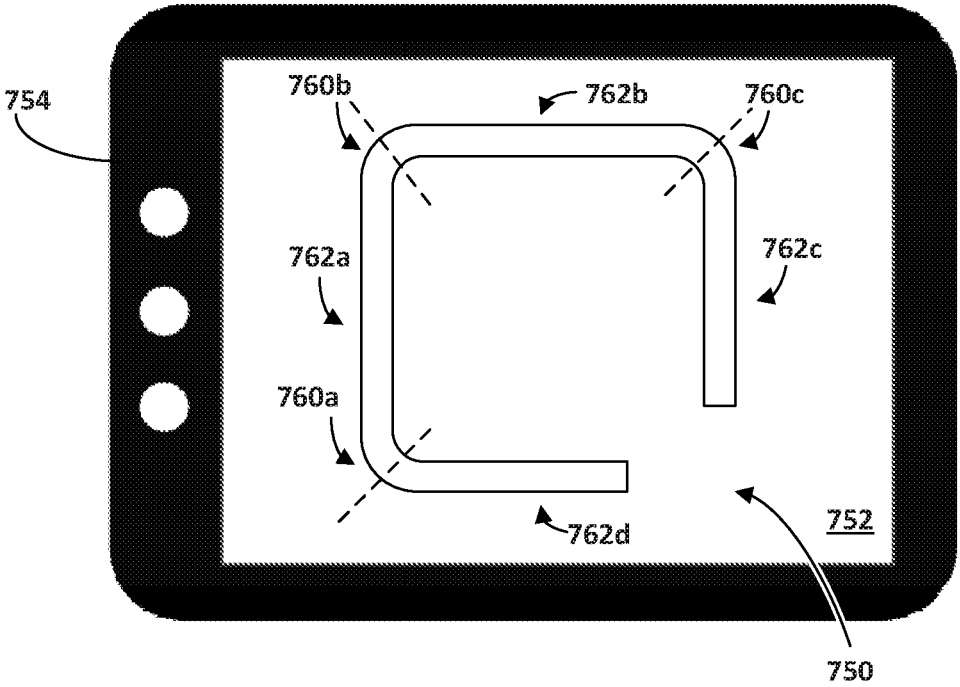

LIGHTING CONTROL BASED ON DEFORMATION OF FLEXIBLE LIGHTING STRIP

CROSS-REFERENCE TO PRIOR APPLICATIONS

This application is the U.S. National Phase application under 35 U.S.C. § 371 of International Application No. PCT/IB2015/055283, filed on Jul. 13, 2015, which claims the benefit of U.S. Patent Application No. 62/026,170, filed on Jul. 18, 2014. These applications are hereby incorporated by reference herein.

TECHNICAL FIELD

The present invention is directed generally to lighting control. More particularly, various inventive methods and apparatus disclosed herein relate to controlling light emitted by light sources on flexible strips based on one or more deformations detected in those flexible strips.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g., red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Lighting strips such as LED strips or ropes may be flexible so that they may be bent, twisted, and in some cases (e.g., with textile-based strips), even stretched. Lighting strips may be used to for various illumination-related purposes, such as illuminating a ceiling recess, illuminating the perimeter of a picture frame or window, illuminating a walkway, illuminating the top of a cabinet, and so forth. It may be possible to independently control one or more properties of light emitted by one or more light sources of a lighting strip using various mechanisms, such as by operating a portable computing device to communicate with a lighting system bridge. However, there is a need in the art to provide other means for independently controlling individual light sources, or groups of light sources, as well as for adaptively controlling light emission based on a shape of the lighting strip itself (or a portion thereof).

SUMMARY

The present disclosure is directed to inventive methods and apparatus for lighting control. For example, an elongate and flexible lighting strip may be provided with one or more sensors (e.g., an array of electrodes) configured to provide one or more signals indicative of a shape into which the flexible lighting strip is formed. When a deformation such as a bend, twist or stretch is introduced into the flexible lighting strip, the deformation may be detected based on a change in the signals provided by the one or more sensors. For example, in some embodiments, a change in impedance (e.g., capacitive or resistive) between two or more electrodes may indicate a deformation in the flexible lighting strip at that location. Light sources of the flexible lighting strip may be selectively energized in various ways based on the detected deformation(s). In some embodiments, light sources in logical partitions of the flexible lighting strip separated by the one or more detected deformations may be energized differently and/or controlled independently from each other.

Generally, in one aspect, an illumination system may include: an elongate flexible strip; a plurality of light-emitting diodes (LEDs) secured along the flexible strip; one or more sensors configured to provide one or more signals indicative of a shape formed by the flexible strip; and a controller communicably coupled with the plurality of LEDs and the one or more sensors. The controller may be configured to: detect one or more deformations in the flexible strip based on the one or more signals provided by the one or more sensors; and selectively energize one or more LEDs of the plurality of LEDs to emit light having one or more lighting properties selected based on the detected one or more deformations.

In various embodiments, a the controller may be further configured to: organize the flexible strip into a plurality of logical partitions separated by the one or more detected deformations; energize one or more LEDs contained in a first of the plurality of logical partitions to emit light having a first lighting property; and energize one or more LEDs contained in a second of the plurality of logical partitions to emit light having a second lighting property that is different than the first lighting property. In various versions, the controller may be further configured to facilitate independent control of one or more properties of light emitted by one or more LEDs in each of the plurality of logical partitions. In various versions, the controller may be further configured to generate and provide, to a remote computing device, information configured to cause the remote computing device to render a user interface that is operable by a user to independently control one or more properties of light emitted by one or more LEDs in each of the plurality of logical partitions. In various versions, the controller may be further configured to energize one or more LEDs at or near the one or more detected deformations to have a third lighting property that is different than the first or second lighting properties.

In various embodiments, the controller may be integral with the flexible strip or separate from, but in communication with, the one or more sensors over one or more wired or wireless communication networks. In various embodiments, the one or more sensors may include an array of planar electrodes. In various versions, the array of planar electrodes are mounted to a surface of the flexible strip parallel to the surface, and the controller is configured to identify one or more bends in the flexible strip based on a change in impedance detected in the array of planar electrodes. In various versions, the array of planar electrodes is a first array of planar electrodes, the surface is a first surface, and the illumination system further includes a second array of planar electrodes mounted to a second surface of the flexible strip opposite the first surface, wherein the second array of planar electrodes are mounted parallel to the second surface. In various versions, the array of planar electrodes are mounted to a surface of the flexible strip perpendicular to the surface, and the controller is configured to identify one or more bends, twists or stretches in the flexible strip based on a change in impedance detected in the array of planar electrodes.

In various embodiments, the illumination system may include an accelerometer, and the controller may be further configured to detect an orientation of the flexible strip based on a signal provided by the accelerometer. In various versions, the controller may be further configured to determine, based on the signal provided by the accelerometer, that a stretch in the flexible strip is at least partially attributable to gravity.

In various embodiments, the illumination system may include a gyroscope operably coupled with the controller. The controller may be further configured to determine a yaw of the flexible strip based on a signal from the gyroscope. In some embodiments, the controller may be configured to select the first or second lighting property based at least in part on the yaw.

In various embodiments, the controller may be further configured to detect, based on the one or more signals provided by the one or more sensors, the shape formed by the flexible strip. In various versions, the controller may be further configured to generate and provide, to a remote computing device, information configured to cause the remote computing device to render a user interface that is operable by a user to view the detected shape of the flexible strip. In various versions, the controller may be further configured to select, based on the detected shape, one or more properties of light emitted by one or more LEDs of the plurality of LEDs. In various versions, the controller may be further configured to select, based on the detected shape, one or more lighting scenes to be implemented by one or more LEDs of the plurality of LEDs.

In another aspect, a lighting control method may include: obtaining, from one or more sensors secured to a light-emitting diode ("LED") lighting strip, one or more signals indicative of a shape formed by the LED lighting strip; detecting one or more deformations in the LED lighting strip based on the one or more signals provided by the one or more sensors; energizing one or more LEDs contained in a first logical partition of the LED lighting strip bound by at least one deformation to emit light having a first property; and energizing one or more LEDs contained in a second logical partition of the LED lighting strip separated from the first logical partition by at least one deformation to emit light having a second property that is different than the first property.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g., for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

A "deformation" as used herein may refer to an alteration of a shape of a flexible lighting strip from a default or nominal shape. Deformations may include but are not limited to bends, twists, or stretches formed in the flexible lighting strip. A "logical partition" of a lighting strip refers to a contiguous region of the strip that is bound by one or more detected deformations. For example, suppose a user secures a flexible lighting strip around the perimeter of a rectangular picture frame. Each region of the flexible strip that lies along a side of the rectangular picture frame may be considered a separate logical partition, bound by the bends formed at each corner of the picture frame. In some embodiments, light sources such as LEDs contained in a logical partition may emit light having different properties than light sources contained in another logical partition. In some embodiments, light sources such as LEDs contained in a logical partition may be selectively energized independently of light sources contained in another logical partition.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

FIG. 4 illustrates schematically another example of how sensors may be deployed on a flexible lighting strip, in accordance with various embodiments.

FIGS. 5-6 illustrate schematically another example of how sensors may be deployed on a flexible lighting strip, in accordance with various embodiments.

FIG. 7 depicts schematically an example of a user interface that may be operable to control light emitted by light sources of a flexible lighting strip that has been deformed in a particular manner, in accordance with various embodiments.

DETAILED DESCRIPTION

Lighting strips such as LED strips or ropes may be flexible so that they may be bent, twisted, and/or stretched. While independent control of one or more properties of light emitted by one or more light sources of a lighting strip may be possible, there is a need in the art to provide other means for independently and/or adaptively controlling individual light sources, or groups of light sources, on a flexible lighting strip. More generally, Applicants have recognized and appreciated that it would be beneficial to configure a flexible lighting strip to emit light differently depending on how it is deformed and/or shaped. In view of the foregoing, various embodiments and implementations of the present invention are directed to methods, systems and apparatus associated with flexible lighting strips that, when deformed, emit light in various ways. In some embodiments, flexible lighting strips may be organized into logical partitions that may emit different kinds of light, and/or for which illumination may be independently and/or adaptively controllable.

Figure 1:
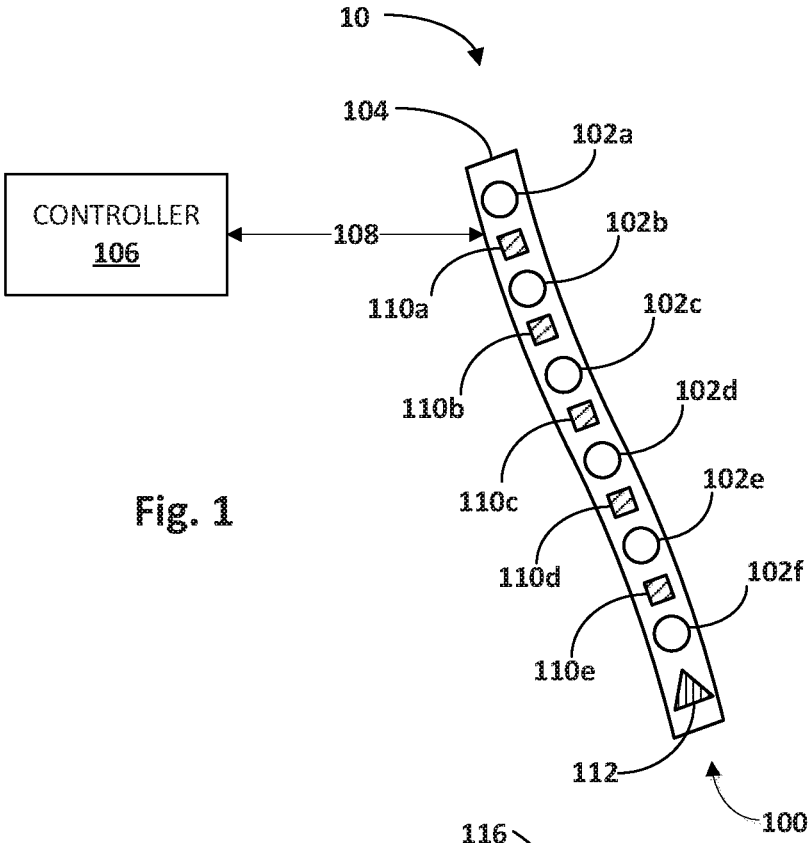
FIG. 1 illustrates schematically example components of an illumination system configured with selected aspects of the present disclosure, in accordance with various embodiments.

Referring to FIG. 1, in one embodiment, an illumination system 10 may include a flexible lighting strip 100, which itself may include a plurality of light sources 102*a-f* (referred to generically as "light sources 102") secured along one or both sides of an elongate flexible strip 104. Light sources 102 may come in various forms, such as LED, incandescent, halogen, fluorescent, and so forth. In some embodiments, more than one type of light source may be employed on a single flexible strip 104. In various embodiments, one or more properties of light emitted by light sources, such as hue, saturation, brightness, intensity, color temperature, etc., may be controllable. Elongate flexible strip 104 may have various lengths, and various numbers of light sources 102 may be secured along those lengths at various intervals and/or densities, and on one or both sides.

Light sources 102 may be communicably coupled with a controller 106 via one or more communication links 108. In some embodiments, controller 106 may be integral with flexible strip 104, in which case communication link 108 may take the form of one or more buses or other transmission means that may be found, for instance, on a printed circuit board. In other embodiments, controller 106 may be separate from flexible strip 104. In such embodiments, communication link 108 may take the form of a wireless or wired communication link that employs various communication technologies, such as WiFi, BlueTooth, near field communication ("NEC"), Ethernet, coded light, or ad hoc communication technologies such as ZigBee.

Controller 106 may also be communicably coupled with a plurality of sensors 110*a-e* (referred to generically as "sensors 110"). Sensors 110 may be configured to provide one or more signals indicative of a shape formed by flexible strip 104. Based on these signals, in various embodiments, controller 106 may detect one or more deformations (not depicted in FIG. 1) in flexible strip 104. As noted previously, deformations may come in various forms, such as bends, twists, or stretches of flexible strip 104. Based on the detected deformations, controller 106 may selectively energize light sources 102 in various ways. For example, in some embodiments, the degree of a bend may dictate a brightness (or a degree of another lighting property) of light emitted by light sources 102. As another example, controller 106 may organize flexible strip 104 into a plurality of logical partitions (not depicted in FIG. 1) separated by the one or more detected deformations. Controller 106 may then energize light emitted by light sources 102 within each of the logical partitions differently. In some embodiments, light emitted from light sources in one logical partition may be controllable independently from light emitted from light sources in another logical partition.

In some embodiments, an orientation sensor 112 may be configured to provide signals indicative of an orientation of flexible strip 104, e.g., relative to gravity. In some embodiments, orientation sensor 112 may include an accelerometer. In some embodiments, controller 106 may be configured to determine, based on the signal provided by orientation sensor 112, that a stretch in flexible strip 104 is at least partially attributable to gravity (e.g., as would occur to a portion of flexible strip 104 that is draped over a top corner of a rectangular picture frame). In some embodiments, orientation sensor 112 may include a gyroscope that provides a signal that can be used by controller 106 to determine, for example, a yaw of flexible strip 104. In some embodiments, a signal from both an accelerometer and a gyroscope may be combined, e.g., using a Kalman filter, to determine the yaw. Once the yaw is known, it may be determined whether flexible strip 104 is bent inwards or outwards, e.g., around a cove in a ceiling or around a table.

Figure 2:
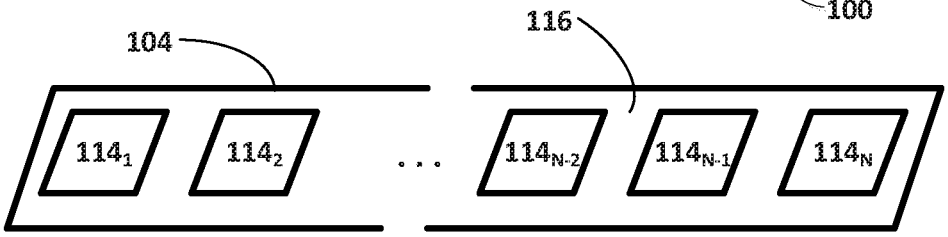
FIGS. 2-3 illustrate schematically on example of how sensors may be deployed on a flexible lighting strip, in accordance with various embodiments.
Figure 3:
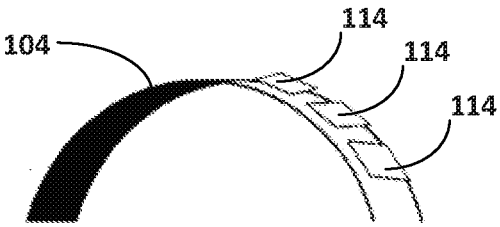

Sensors 110 may be implemented in various ways. One example is depicted in FIG. 2, in which sensors are implemented using an array of N (N=positive integer) planar electrodes 114 that are disposed on (or in some cases, embedded in or underneath) a surface 116 of flexible strip 104 parallel to surface 116. In such an embodiment, controller 106 may be configured to identify one or more deformations such as bends in flexible strip 104 based on one or more changes in impedance (resistive or capacitive, absolute or relative) detected in the array of planar electrodes 114. As shown in FIG. 3, when flexible strip 104 is bent, the relative positions of planar electrodes 114 may be altered, which in turn may change impedance between two or more planar electrodes 114. This change in impedance may be used by controller 106 to detect the bend.

FIG. 4 depicts another example of how sensors 110 may be implemented. Here, a first array of N planar electrodes 114 is once again disposed on a first surface 116 of flexible strip 104, and may operate in a manner similar to those of FIG. 2. However, an additional array of N planar electrodes 114' is disposed on, and parallel to, a second surface 116' of flexible strip 104 that is opposite the first surface 116. In this example, when flexible strip 104 is bent upwards on each side, a capacitance between planar electrodes $\mathbf{114}_1$ and $\mathbf{114}_2$ may increase while a capacitance between planar electrodes $\mathbf{114'}_1$ and $\mathbf{114'}_2$ may decrease. When flexible strip 104 is bent downwards on each side, a capacitance between planar electrodes $\mathbf{114}_1$ and $\mathbf{114}_2$ may decrease while a capacitance between planar electrodes $\mathbf{114'}_1$ and $\mathbf{114'}_2$ may increase.

While capacitance and impedance are used as the electrical measurement in the examples herein, this is not meant to be limiting. Depending on how sensors 110 are implemented, various other changes in various measurements related to electricity may be measured and used to detect deformations. For example, in some embodiments, changes in electrical or magnetic field between sensors 110 (e.g., electrodes 114) may be measured and used to detect deformations.

FIGS. 5-6 depict another example of how sensors 110 may be implemented. Here, an array of N planar electrodes 114 are disposed on a surface 116 of flexible strip 104 perpendicular to surface 116. FIG. 6 shows from a side profile view in the left two images how spatial relationships between those planar electrodes 114 may be altered in response to stretching and bending of flexible strip 104. The rightmost image in FIG. 6 is a front profile view depicting how spatial relationships between planar electrodes 114 may be altered as a result of twisting of flexible strip 104. These changes in spatial relationships may cause corresponding changes in impedance (or capacitance, or electrical or magnetic field) between planar electrodes 114. These changes in impedance may be analyzed by controller 106 to detect a shape of flexible strip 104, as well as to detect one or more stretches, bends or twists of flexible strip 104.

In some embodiments, a bend or twist detected in flexible strip 104 may be represented as bend or twist angles. A stretch detected in flexible strip 104 may be represented as a stretch coefficient. In some embodiments, controller 106 may, on detecting a stretch in flexible strip 104, cause one or more light sources 102 at or near the stretched area to act together to keep light emission uniform across the stretch.

While more planar electrodes 114 are depicted in FIG. 5 than were depicted in FIG. 2, that is not meant to be limiting. Any number of planar electrodes 114 may be employed on flexible strips 104 of various lengths. More generally, planar electrodes 114 may be dispersed at various intervals along flexible strip 104 and/or at various densities thereon. The density of the distribution of planar electrodes 114 along flexible strip 104, or more generally, the density of the distribution of sensors 110, may be greater than, equal to, or less than a density of a distribution of light sources 102 along flexible strip 104.

Sensors 110 may come in other forms as well, such as resistive bend sensors. In some embodiments, a strip resistance-based bend sensor such as the Spectra Symbol Flex Sensor may be embedded into flexible strip 104.

FIG. 7 depicts an example user interface 750, operable to control light emitted by one or more light sources 102 on flexible strip 104, that may be rendered on a display 752

(e.g., a touch screen) of a computing device 754. While computing 754 is depicted as a smart phone or tablet computer, this is not meant to be limiting. Computing device may come in other forms, including but not limited to wearable computing devices (e.g., smart glasses, smart watches), laptop computers, desktop computers, set top boxes, and so forth. In some embodiments, controller 106 may generate and provide to computing device 754 data configured to cause computing device 754 to render user interface 750, though this is not required.

In this example, flexible strip 104 (with light sources that are not shown in FIG. 7) is contorted into roughly the shape of a square, with three approximately 90-degree bends 756*a-c* separating four sides 758*a-d*. Controller 106 (not depicted in FIG. 7, see FIG. 1) may obtain signals from one or more sensors 110 (not depicted in FIG. 7, see FIG. 1) disposed along flexible strip 104. Based on these signals, controller 106 may detect (as deformations) the three bends 756*a-c*. In some embodiments, based on the signals and/or on detected deformations, controller 106 may detect (e.g., using trigonometric or other calculations) an overall shape of flexible strip 104. Controller 106 may then organize flexible strip 104 into four logical regions that correspond to the four sides 758*a-d* of the square shape. In some embodiments, interface 750 may be operable to adjust boundaries between logical partitions 762*a-d*, e.g., by dragging edges that separate them to different locations.

User interface 750 depicts the detected shape on display 752. The detected bends are indicated at 760*a-c* and the logical partitions are indicated at 762*a-d* (shown with dashed lines separating them). In various embodiments, a user may be able to independently control of one or more properties of light emitted by one or more light sources in each of the plurality of logical partitions 762*a-d*. For example, in some embodiments, user interface 750 may be operable, e.g., by tapping on one of the logical partitions 762*a-d*, bring up another interface (not depicted in FIG. 7) that allows a user to select hue, saturation, intensity, color temperature, dynamic lighting sequence, lighting scene, etc. of light emitted by one or more light sources in that particular logical partition.

Figure 8:
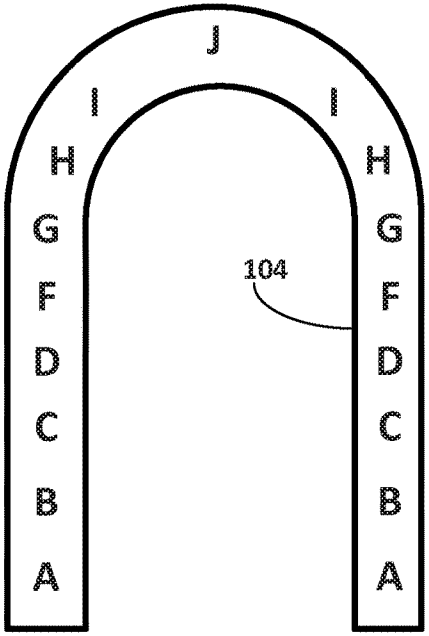
FIGS. 8-9 depict examples of how lighting properties to be emitted by light sources of a flexible lighting strip may be selected, in accordance with various embodiments.
Figure 9:
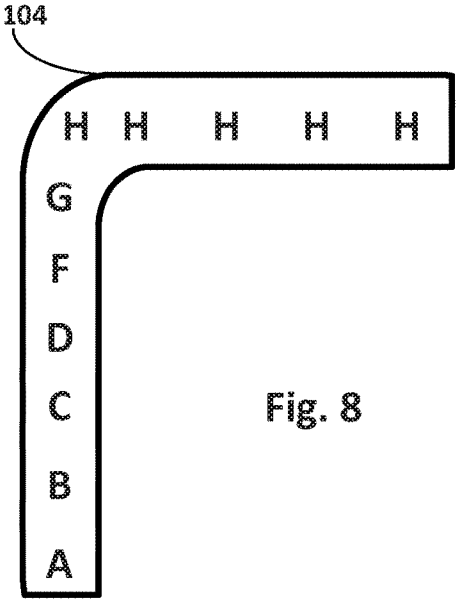

In some embodiments, controller 106 may select one or more properties of light emitted by one or more light sources 102 on flexible strip 104 based on a detected shape into which flexible strip 104 is formed. FIGS. 8 and 9 depict two such examples. In FIG. 8, two flexible strips 104 are shown forming two different shapes: a 90-degree bend and a U-shape. In each instance, light sources (not individually depicted in FIGS. 8-9) are configured to collectively emit light having a gradient of properties, such as a gradient of hues (as might be seen in a rainbow, for instance), a gradient of brightness (e.g., dark to light, or vice versa), and so forth. The different levels of the gradient are represented by the letters A-J.

In each example of FIG. 8, controller 106 may determine the shape into which flexible strip 104 is formed, and may select the gradient levels A-J to be emitted by light sources in each region of flexible strip 104 based on the detected shape. In the example on the left (90-degree bend), the gradient starts at "A" and goes up through "H," at which point flexible strip 104 is bent to the right. Beyond that point, the gradient remains at "H" because flexible strip 104 extends no further upwards. In the example on the right (U-shape), the gradient once again starts at "A" and proceeds through "I" going up both "legs" of the U-shape of flexible strip 104. The gradient culminates in the value "J" in the middle of the U. Because flexible strip 104 on the right extends upwards further than the one on the left, it includes the gradient values "I" and "J."

In FIG. 9, flexible strip 104 has been formed into a coil shape. This may be detected by controller 106, e.g., based on one or more signals from one or more sensors 110. Controller 106 may select one or more properties of light to be emitted by one or more light sources 102 on flexible strip 104 based on the detected coil shape. For instance, in some embodiments, controller 106 may cause light sources to create a gradient of a lighting property (e.g., rainbow, bright-to-dark, etc.) that cascades one way or the other through the coil. In some embodiments, controller 106 may select a lighting scene based on the detected coil shape. For instance, controller 106 may select a series of properties of light to be emitted by a plurality of light sources 102 to make the coil have the coloring of a snake. In some embodiments, controller 106 may select a dynamic lighting effect to be implemented by a plurality of light sources 102 on flexible strip 104 based on the detected coil shape. For instance, controller 106 may select a flame effect in response to the detected coil, or may select a holiday effect in response to a detected Christmas tree-shape formed by flexible strip 104.

In some embodiments, instead of controller 106 selecting the dynamic lighting effect, a user may configure the dynamic lighting effect using various mechanisms. In some embodiments, the user may obtain, e.g., using a computing device such as a smart phone or tablet computer, an animation or video that has colors or other lighting properties that may be "projected" onto flexible strip by controller 106. For example, a user may use an interface such as that depicted in FIG. 7 to cause light sources 102 in one or more logical partitions 762*a-d* to emit light to achieve various effects (e.g., flame, water rippling, etc.).

Figure 10:
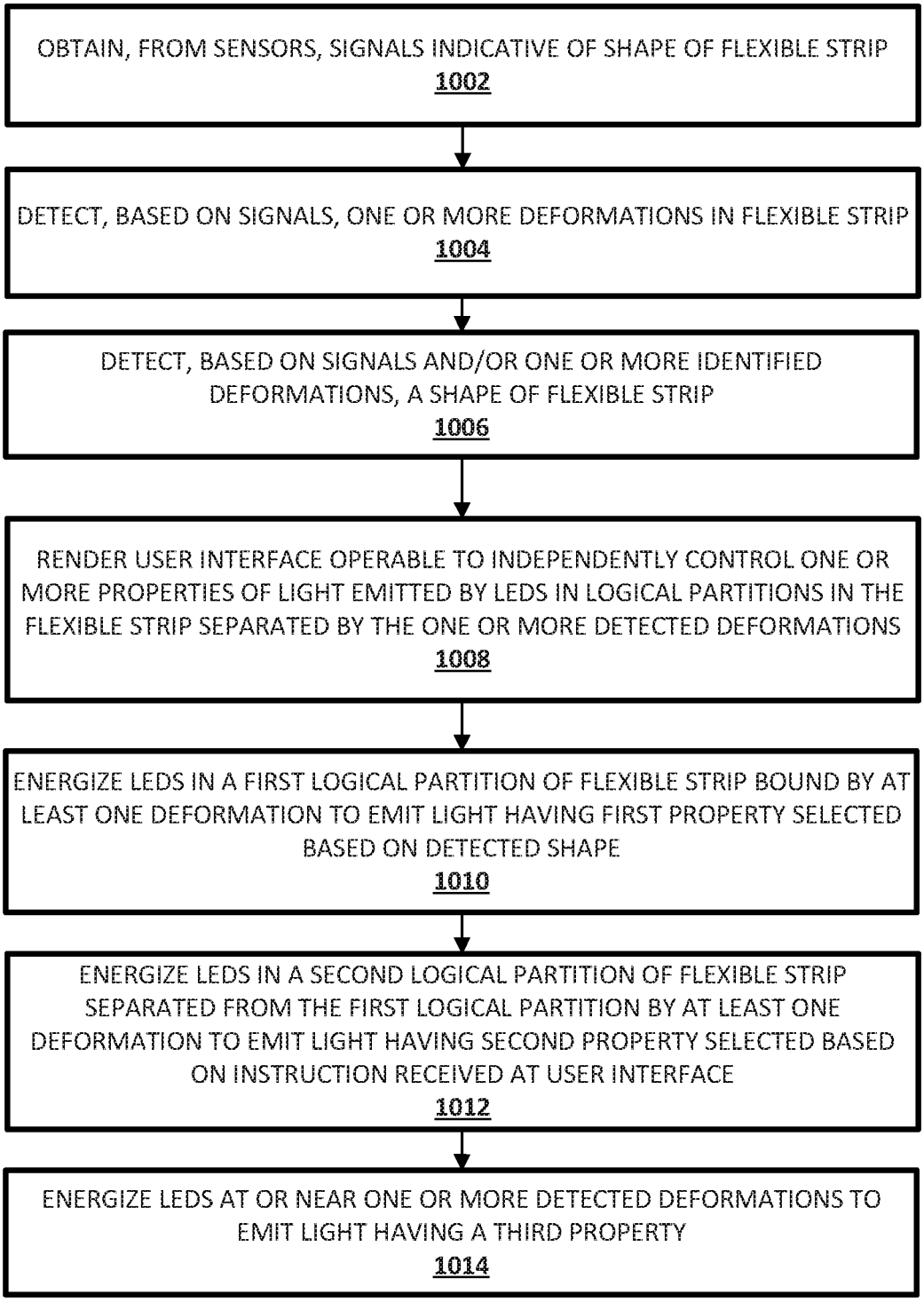
FIG. 10 depicts an example lighting control method, in accordance with various embodiments.

Referring now to FIG. 10, an example lighting control method 1000 that may be performed in part by, for instance, controller 106, is depicted, in accordance with various embodiments. While various operations are shown in a particular order, this is not meant to be limiting. One or more operations may be reordered, added, altered or omitted without departing from the spirit of the present disclosure.

At block 1002, signals indicative of a shape of a flexible lighting strip (e.g., 104) may be obtained, e.g., from a plurality of sensors (e.g., planar electrodes 114). At block 1004, controller 106 may detect, based on the signals obtained at block 1002, one or more deformations (e.g., bends, twists, stretches, etc.) formed in flexible strip 104. For example, controller 106 may determine that impedance between two or more planar electrodes 114 has changed in a manner that suggests a twist has been formed in that area of flexible strip 104.

At block 1006, controller 106 may detect a shape formed by flexible strip 104. In some embodiments, controller 106 may detect this shape based on signals obtained at block 1002. In some embodiments, controller 106 may detect this shape based on signals obtained at block 1002 in combination with one or more deformations detected at block 1006. For instance, controller 106 may determine that four 90-degree bends yields a rectangle. In some embodiments, controller 106 may additionally detect an orientation of the shape, e.g., based on one or more signals from orientation sensor 112.

At block 1008, a user interface (e.g., 750 in FIG. 7) may be rendered, e.g., on computing device 754, that is operable to independently control one or more properties of light emitted by one or more light sources in one or more logical partitions of flexible strip 104 separated by the one or more deformations detected at block 1004. In some embodiments, data configured to facilitate rendering of interface 750 may be provided by controller 106.

At block 1010, controller 106 may energize one or more light sources 102 in a first logical partition of flexible strip 104 bound by at least one deformation to emit light having a first lighting property. In FIG. 10, the first lighting property is selected based on the shape of flexible strip 104 detected at block 1006, but this is not meant to be limiting. The first lighting property may be selected based on other input.

At block 1012, controller 106 may energize one or more light sources 102 in a second logical partition of flexible strip 104 separated from the first logical partition by at least one deformation to emit light having a second lighting property. The second lighting property may be different than the first lighting property selected at block 1010. In FIG. 10, this second lighting property is selected based on one or more instructions received at a user interface (e.g., 750), but this is not meant to be limiting. The second lighting property may be selected based on other input.

At block 1014, controller 106 may energize one or more light sources 102 at or near one or more deformations detected at block 1004 to emit light having a third lighting property that may or may not be different than the first or second lighting properties. For example, in some embodiments, controller 106 may energize one or more light sources 102 at or near a corner bend formed in flexible strip 104 somewhat more or less brightly (e.g., by a multiplication factor) than other light sources 102. In some embodiments, controller 106 may energize one or more light sources 102 at or near deformations to emit a property of light selected based on other data, such as a yaw of flexible strip 104 provided by a gyroscope, or an orientation of flexible strip 104 provided by orientation sensor 112. In some embodiments, user interface 750 may be operable to adjust multiplication factors or other inputs that affect how light sources 102 at or near deformations (e.g., bend, twist, stretch) emit light compared to at other portions of flexible strip 104.

While the examples described herein have referred to a controller 106 that is centralized relative to the sensors and light sources, this is not meant to be limiting. In some embodiments, control may be more distributed. For instance, signals from sensors may be used more locally, e.g., at a few nearby LEDs, to select one or more lighting properties to be emitted. This may enable a flexible lighting strip that automatically adapts its luminance to its environment. For example, if draped around a rectangular picture frame, light sources near sensors at the corners may illuminate more or less light, and light sources along the sides of the picture frame may also illuminate more or less light (or light having another different property than light emitted at the corners).

In some embodiments, a single controller may control light output by light sources distributed across more than one flexible lighting strip. For instance, in some embodiments, flexible lighting strips may be connected and/or strung out in sequence. One or more controllers in communication with light sources on those strips may be configured to treat the multiple lighting strips as one long single strip. The controller may for instance determine an overall shape of that combined strip, and/or one or more deformations formed in the combined strip. Using this data, the controller may organize the combined strip into logical partitions. In such case, a logical partition could extend between two different individual flexible lighting strips.

Sensing deformations in flexible strip 104 may require considerable energy. If controller 106 and/or one or more light sources 102 on flexible strip 104 are battery-powered, various techniques may be employed to conserve energy. For instance, one or more sensors 110 may only be activated at particular moments (e.g., just after power is turned on) and/or for particular time periods (e.g., one minute after power is turned on). In some embodiments, one or more sensors 110 may be manually activated by a user, e.g., by flipping a switch or performing some action with flexible strip 104, such as shaking it (which may be detected, for instance, by orientation sensor 112).

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An illumination system, comprising:

an elongate flexible strip;

a plurality of light-emitting diodes secured along the flexible strip;

one or more sensors configured to provide one or more signals indicative of a shape formed by the flexible strip; and a controller communicably coupled with the plurality of LEDs and the one or more sensors, the controller being configured to:

detect one or more deformations in the flexible strip based on the one or more signals provided by the one or more sensors; and selectively energize one or more LEDs of the plurality of LEDs to emit light having one or more lighting properties selected based on the detected one or more deformations.

2. The illumination system of claim 1, wherein the controller is further configured to:

organize the flexible strip into a plurality of logical partitions separated by the one or more detected deformations;

energize one or more LEDs contained in a first of the plurality of logical partitions to emit light having a first lighting property; and energize one or more LEDs contained in a second of the plurality of logical partitions to emit light having a second lighting property that is different than the first lighting property.

3. The illumination system of claim 2, wherein the controller is further configured to facilitate independent control of one or more properties of light emitted by one or more LEDs in each of the plurality of logical partitions.

4. The illumination system of claim 3, wherein the controller is further configured to generate and provide, to a remote computing device, information configured to cause the remote computing device to render a user interface that is operable by a user to independently control one or more properties of light emitted by one or more LEDs in each of the plurality of logical partitions.

5. The illumination system of claim 2, wherein the controller is further configured to energize one or more LEDs at or near the one or more detected deformations to have a third lighting property that is different than the first or second lighting properties.

6. The illumination system of claim 1, wherein the controller is integral with the flexible strip.

7. The illumination system of claim 1, wherein the controller is in communication with the one or more sensors over one or more wired or wireless communication networks.

8. The illumination system of claim 1, wherein the one or more sensors comprise an array of planar electrodes.

9. The illumination system of claim 8, wherein the array of planar electrodes are mounted to a surface of the flexible strip parallel to the surface, and the controller is configured to identify one or more bends in the flexible strip based on a change in impedance detected in the array of planar electrodes.

10. The illumination system of claim 9, wherein the array of planar electrodes is a first array of planar electrodes, the surface is a first surface, and the illumination system further comprises a second array of planar electrodes mounted to a second surface of the flexible strip opposite the first surface, wherein the second array of planar electrodes are mounted parallel to the second surface.

11. The illumination system of claim 8, wherein the array of planar electrodes are mounted to a surface of the flexible strip perpendicular to the surface, and the controller is configured to identify one or more bends, twists or stretches in the flexible strip based on a change in impedance detected in the array of planar electrodes.

12. The illumination system of claim 2, further comprising a gyroscope operably coupled with the controller, wherein the controller is further configured to determine a yaw of the flexible strip based on a signal from the gyroscope, and to select the first or second lighting property based at least in part on the yaw.

13. The illumination system of claim 1, further comprising an accelerometer, wherein the controller is further configured to detect an orientation of the flexible strip based on a signal provided by the accelerometer.

14. The illumination system of claim 13, wherein the controller is further configured to determine, based on the signal provided by the accelerometer, that a stretch in the flexible strip is at least partially attributable to gravity.

15. The illumination system of claim 1, wherein the controller is further configured to detect, based on the one or more signals provided by the one or more sensors, the shape formed by the flexible strip.

16. The illumination system of claim 15, wherein the controller is further configured to generate and provide, to a remote computing device, information configured to cause the remote computing device to render a user interface that is operable by a user to view the detected shape of the flexible strip.

17. The illumination system of claim 15, wherein the controller is further configured to select, based on the detected shape, one or more properties of light emitted by one or more LEDs of the plurality of LEDs.

18. The illumination system of claim 15, wherein the controller is further configured to select, based on the detected shape, one or more lighting scenes to be implemented by one or more LEDs of the plurality of LEDs.

19. A lighting control method, comprising:

obtaining, from one or more sensors secured to a light-emitting diode ("LED") lighting strip, one or more signals indicative of a shape formed by the LED lighting strip;

detecting one or more deformations in the LED lighting strip based on the one or more signals provided by the one or more sensors;

energizing one or more LEDs contained in a first logical partition of the LED lighting strip bound by at least one deformation to emit light having a first property; and energizing one or more LEDs contained in a second logical partition of the LED lighting strip separated from the first logical partition by at least one deformation to emit light having a second property that is different than the first property.

20. The lighting control method of claim 19, further comprising energizing one or more LEDs at or near the one or more detected deformations to have a third lighting property that is different than the first or second lighting properties.

* * * * *